United States Patent [19]

Pettengill

[11] 4,132,207

[45] Jan. 2, 1979

[54] VEHICLE FUEL INJECTION SYSTEM

[76] Inventor: Ned H. Pettengill, Box 37, S. Royalton, Vt. 05068

[21] Appl. No.: 690,942

[22] Filed: May 28, 1976

[51] Int. Cl.[2] ..... F02M 29/00

[52] U.S. Cl. ..... 123/141; 123/133; 123/122 AC; 123/122 AB; 261/DIG. 55; 48/180 R

[58] Field of Search ..... 123/122 E, 133, 141, 123/52 M, 52 MV, 122 AC, 122 AB; 165/52; 261/DIG. 55, DIG. 21; 48/180 R

[56] References Cited

U.S. PATENT DOCUMENTS

| | | | |
|---|---|---|---|
| 1,017,186 | 2/1912 | Steward | 123/122 AC |
| 1,479,381 | 1/1924 | Good | 123/122 AC |
| 1,490,921 | 4/1924 | Godward | 123/122 AC |
| 1,530,157 | 3/1925 | Edwards | 123/122 AC |
| 3,109,416 | 11/1963 | Rose | 123/52 MV |
| 3,448,729 | 6/1969 | Parsons | 123/52 M |
| 3,564,580 | 2/1971 | Cinque | 123/141 |
| 3,832,985 | 9/1974 | Edde | 123/141 |
| 3,847,125 | 11/1974 | Malherb | 123/141 |
| 3,851,634 | 12/1974 | Everette | 123/133 |
| 3,875,918 | 4/1975 | Loynd | 123/52 M |
| 3,942,499 | 3/1976 | Kunik | 123/141 |
| 4,020,811 | 5/1977 | La Force | 123/122 AC |
| 4,030,457 | 6/1977 | Hawryluk | 123/133 |

*Primary Examiner*—Ronald H. Lazarus
*Attorney, Agent, or Firm*—B. P. Fishburne, Jr.

[57] ABSTRACT

A new and novel method and means for injecting a cold charge of fuel into an engine to significantly reduce all exhaust pollutants well below the limits required by law.

13 Claims, 9 Drawing Figures

FIG.1
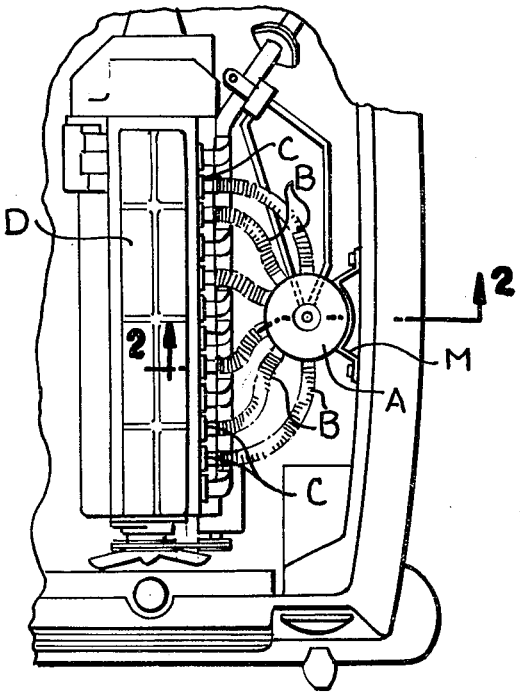
FIG.3
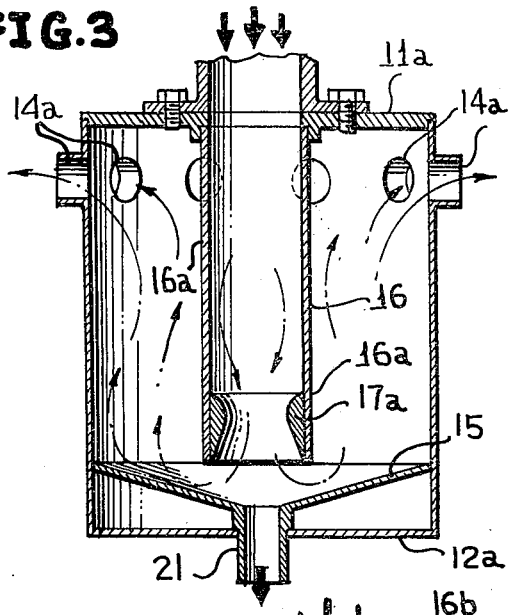
FIG.4
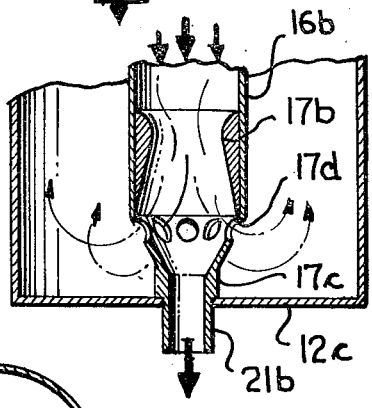
FIG.2
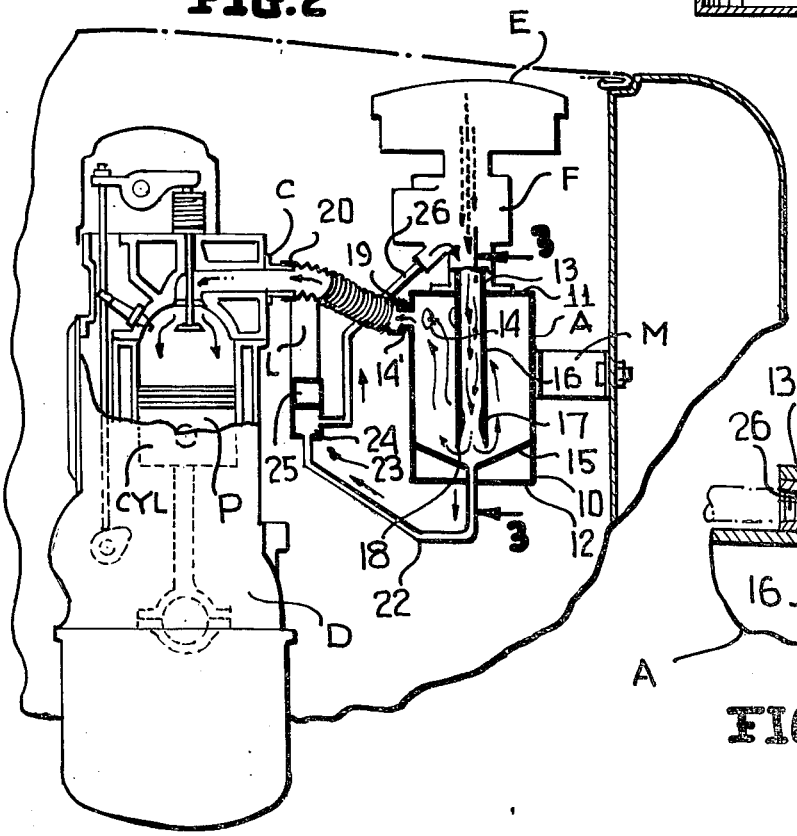
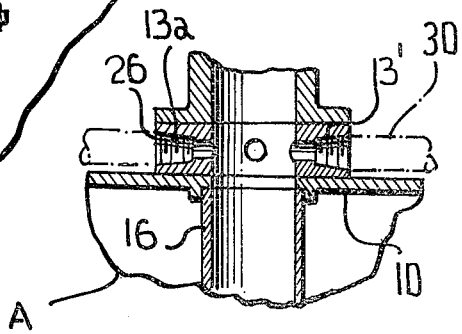
FIG. 3a FIG. 5
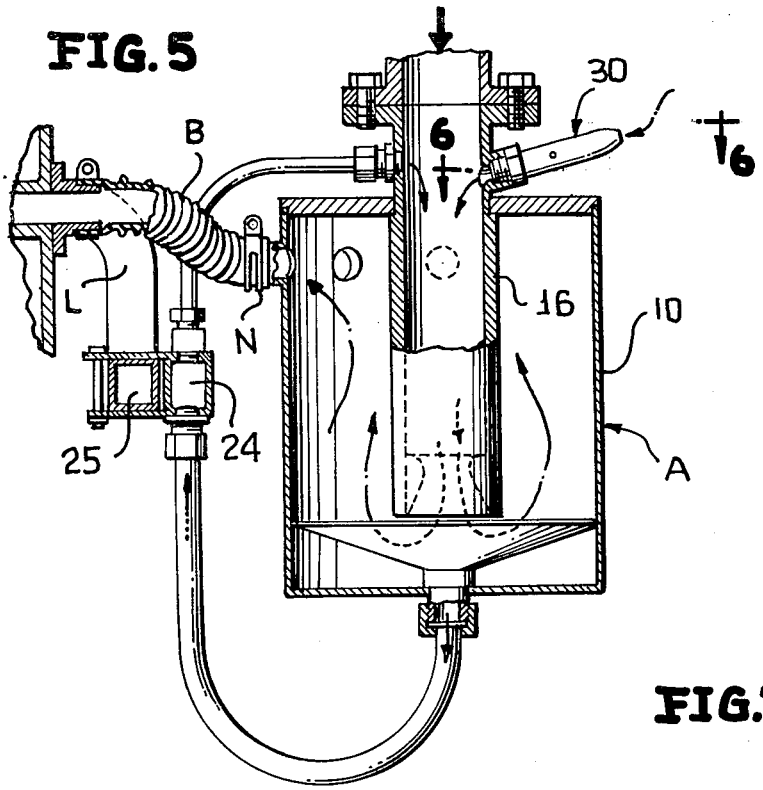
FIG. 6
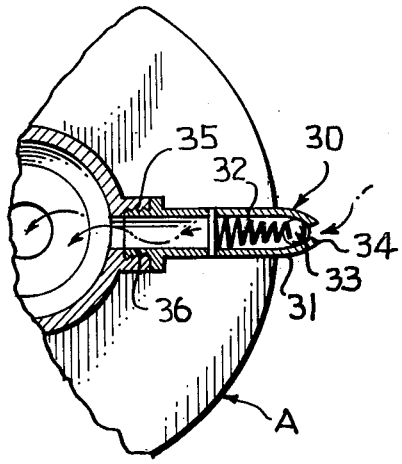
FIG. 7
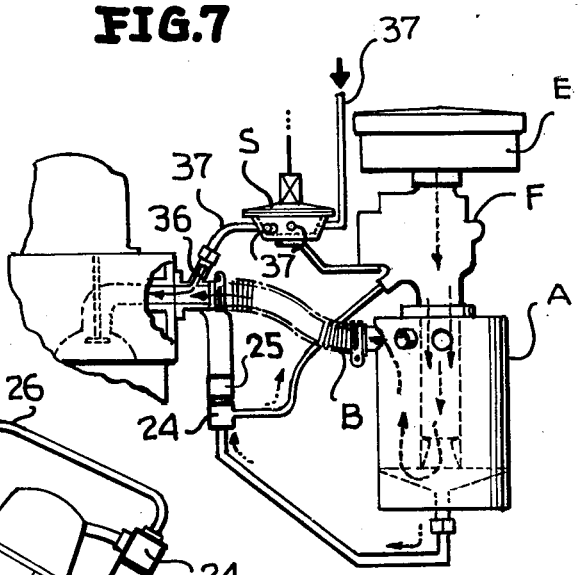
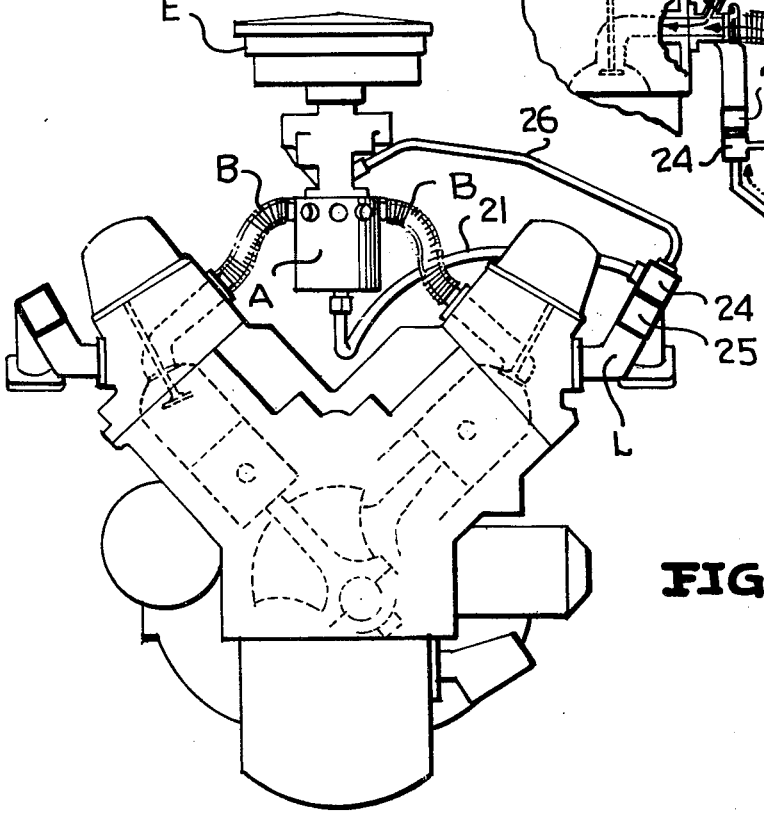
FIG. 8

VEHICLE FUEL INJECTION SYSTEM

BACKGROUND OF THE INVENTION

With the enactment of the Clean Air Act and the regulations passed relative to the contents of the exhaust gas of a vehicle, there has been a continual search for a simple and economical means for reducing the pollutants discharged into the atmosphere. Presently, the automotive industry relies on catalytic converters placed in the exhaust line to comply with the regulations. Obviously, the use of these converters has its attendant problems, for example, they are expensive due to the fact that costly material such as platinum must be used therein; they add more weight to the vehicle, they discharge noxious sulfide odors, they reduce the overall efficiency of the vehicle; they require more gasoline to be used; they cause exhaust back pressure problems; they are only effective at high temperatures and consequently cannot be allowed to stand idle as they have been known to cause grass fires and to melt asphalt when sitting over the same, and to kill people within the vehicle from carbon monoxide fumes due to incomplete combustion, etc.

In this regard, and in the known prior art, U.S. Pat. No. 2,664,864 broadly discusses removing conventional heat from the manifold and supplying a fuel mixture at a relatively low intake temperature thus resulting in a denser charge. However, the patentee lowers the temperature of the fuel-air charge by mounting the intake distributing chambers away from the exhaust manifold and by providing and heating a dam adjacent the intake valve to insure complete vaporization, see Column 2, lines 11–20; lines 45–54. At Column 3, lines 30–35, the patentee further states that his invention is more suitable for an engine wherein the exhaust is disposed oppositely the intake ports. Therefore, and in conclusion, it can be stated that while the patentee spoke of a cooler fuel-air charge, he did not realize the full significance of the same as there is residual heat involved due to the fact that the intake chambers are in metal-to-metal contact with the engine block.

In U.S. Pat. No. 2,573,095 the patentee discloses an intake manifold spaced from the engine wherein, hopefully, the gases therein are maintained as cool as possible, see Column 1, lines 53–56; at Column 3, lines 70–74, the patentee further states that the manifold is still in heat exchange relationship with the engine block via conduits 17, 17*a* and 17*b* and at Column 4, lines 5–10, he further states that the manifold should be made from material having a high heat conductivity. At Column 5, lines 5–8, the patentee does mention there are advantages to cooling the fuel and air mixture, however, he further states that the air utilized is apparently heated to insure vaporization. In this regard, while the patentee realizes advantages to a cooled fuel-air charge he still maintains his manifold in heat exchange relationship with the engine block and utilizes elaborate cooling fins and reflecting surfaces in order that the gases therein be "relatively cool" as specified in the claims.

U.S. Pat. No. 3,561,408 is also known as showing a separate manifold, but like the prior art patents, the same is in heat-conducting relationship with the engine block and therefore has all the attendant deficiencies of said aforementioned patents.

U.S. Pat. No. 2,730,339 discloses a fuel distributing system wherein the fuel-air mixture is fed into successive cylinders via individual tubes connecting the carburetor thereto. As noted, there is no suggestion of introducing a cold charge of a fuel-air mixture into the cylinders.

BRIEF SUMMARY OF THE INVENTION

The present invention relies on the theory that introducing a cold charge of fuel and air mixture into the engine cylinders will significantly reduce the exhaust pollutants discharged into the atmosphere. The apparatus relied on reduces the main exhaust pollutants Co, $NO_x$ and HC well below the minimum standards set by law without impairing the engine efficiency. The apparatus relied on to accomplish the aforementioned result comprises modifying the intake manifold and separating the fuel induction system from the intake manifold and/or engine block, which obviously reduces the temperature associated therewith, and connecting the fuel induction system to the cylinders by non-heat conducting tubes, which further maintains the fuel-air mixture charge in its cooler state and provides for the equal distribution of air-fuel mixture to each of the cylinders. The apparatus further includes a fuel particle separator, an optional vacuum central valve, and air control introducing means associated with the intake cylinder, all of which serve to aid in accomplishing the aforementioned results.

BRIEF DESCRIPTION OF THE DRAWINGS

FIG. 1 is a top view of a vehicle engine showing the new fuel induction-system and distributing tubes in place;

FIG. 2 is a cross-sectional view taken on a line 2—2 of FIG. 1;

FIGS. 3 and 4 disclose modified forms of the venturi associated with the fuel-induction system;

FIG. 3A discloses a modification showing the mounting of a fuel conducting tube and a vacuum control valve in conjunction with a fuel-induction system;

FIG. 5 shows the details of the mixing manifold the particle conducting arrangement and vacuum control valve and their relationship with one another;

FIG. 6 is a sectional view of the vacuum control valve taken on the lines 6—6 at FIG. 5;

FIG. 7 depicts a further modification wherein a solenoid valve controlled auxiliary air-introducing means is incorporated into the system; and FIG. 8 depicts the fuel induction system as associated with a V-8 engine.

PREFERRED DESCRIPTION OF THE INVENTION

The present invention concerns itself with a new and novel fuel induction system utilized in lieu of the conventional intake manifold comprised of a heavy cast iron conduit formed integrally with the engine block and which serves to distribute fuel and air therealong to be fed into each of the standard cylinders. The new fuel induction system and its association with a vehicle engine is shown in FIG. 1 and is designated generally as A having a plurality of conduits B extending therefrom with one each communicating with the intake ports C of the engine D. The engine D is conventional in all major aspects except that the normal intake manifold has been removed to expose the intake ports with which the conduits B communicate.

With reference to FIG. 2, the fuel induction system is seen to comprise a circular container-like receptacle 10 having top and bottom walls 11, 12 with the top being provided with a centrally disposed opening 13 and a plurality of spaced openings 14 radially disposed beneath the top 11 and a ramp surface 15 adjacent the bottom 12. A conventional air filter E and fuel metering device F are mounted on the top wall 11 of the mixing manifold and a conduit 16 extends therefrom through the opening 13 into the interior of the mixing manifold 10. The conduit 16 has a venturi section 17 disposed adjacent its end 18 which terminates short of the ramp surface 15 for reasons explained hereinafter.

With continuing reference to FIG. 2, each of the openings 14 are surrounded by a collar 14' receiving one end 19 of the conduit B with the other end 20 thereof anchored to the intake port C of the engine D. Regarding the hoses B, the same are non-heat conducting and can be formed from rubber, asbestos or any suitable material which will minimize heat transfer from the engine block to the fuel induction system. As seen, the outlet end 20 of each of the hoses B communicates with the piston P and cylinder CYL of the engine D and the same will not be discussed as the operation thereof is conventional and forms no part of the invention.

The aforementioned ramp surface 15 terminates in a discharge opening 21 passing exteriorly of the mixing manifold 10 and extends via tube 22 into a chamber designated generally as 23 comprised of a housing divided into at least two chambers 24, 25. The lower chamber 24, as will be more clearly explained hereinafter, receives fuel particles from the mixing manifold 10 and tube 22 while the upper chamber 25 communicates with a source of heat and preferably heat from the exhaust manifold L of the engine D whereby it passes in heat exchange relationship with the contents of the lower chamber 24. Chamber 24 has a second tube 26 leading therefrom to an inlet portion of the fuel induction system E. In use, the structure described permits the mixture of fuel and air to pass into the interior of the mixing manifold via conduit 16 whereupon the fuel-air charge passes through the venturi 17 section disposed adjacent the end thereof causing the same to accelerate whereupon the lighter particles egressing from the conduit 16 will make a 180° turn and move upwardly, as shown by the arrows, within the mixing manifold 10 to be discharged through the openings 14 into each of the hoses to be conducted to the intake ports C of the engine D. As the lighter particles are discharged, the heavier particles contact the ramp surface 15 and are conducted by the tube 21 to the chamber 24 wherein the same are heated by the exhaust gases being introduced into the chamber 25 and further vaporized and conducted by tube 26 to be re-introduced into the fuel induction system 10. As the openings 14 are equally spaced, the particles will be equally distributed therethrough and consequently the charge to each of the cylinders will be substantially the same.

FIGS. 3 and 4 show modifications of the previously described mixing manifold 10 differing in the construction of the venturi 17 located adjacent the bottom of the inlet tube 16. As seen in FIG. 3, the venturi **17*a* is separately fabricated and placed in the end of the inlet tube 16*a* and held therein by friction, brazing, etc., and functions to direct the lighter particles upwardly to the outlet openings while the heavier particles are directed outwardly to the mixing manifold 10 to be recycled in the same manner as described in the FIG. 2 embodiment. In the FIG. 4 modification, the venturi 17*b* has an extension 17*c* having its lower tapered end seated on the bottom wall 12*c*. A plurality of openings 17*d* are provided in the extension 17*c* below the end of the inlet tube 16*b* through which the lighter particles pass in the manner as previously described while the heavier particles pass downwardly through the tapered end 17*c* and outlet 21*b*** to be reheated and re-introduced into the fuel induction system.

FIG. **3*a* discloses an alternative design for connecting the particle conducting tube 26 to the fuel metering device. In this instance, an annular collar 13' is disposed on the top wall 11 of the mixing manifold 10 and is provided with threaded openings 13*a*, one of which receives the end of the tube 26, and a vacuum control valve in the other. The annular opening of the collar 13' is aligned with the fuel metering device and conduit 16** openings, respectively.

With reference to FIG. 5, the overall operation of the engine is enhanced by incorporating a vacuum control valve into the system. The vacuum control valve is designated generally at 30 and is inserted into the fuel induction system. As seen in FIG. 6, the decelerator valve 30 comprises an elongated open-ended housing 31 having a spring 32 biasing a ball 33 against one opening 34 with the other end 35 being provided with a threaded surface to engage mating threads 36 provided on the inlet tube 16.

Upon deceleration of the vehicle the ball 33 moves against the bias of the spring 32 to open the end 34 to permit air to enter into the interior of the mixing manifold to further aid in the vaporization of the particles. The spring can be calibrated to open at any desired speed upon deceleration. Additionally, and as seen in FIG. 7, the inlet to each of the cylinders C is provided with an inlet opening 36 which receives an air line 37 connected to a solenoid S which selectively opens and closes a passage therein to permit ingress of air from the atmosphere at any desired rpm to further aid in the cooling and the leaning of the air-fuel mixture. The solenoid can be automatically operated, for example, at 1600 rpms or 30 miles per hour or at any suitable speed which is considered important in the overall operation of the vehicle.

Each of the cylinder inlets is provided with an air line emanating from the solenoid S and the same cooperate therewith in the same manner as just described, that is, at a certain rpm or certain speed each of the said inlets will be provided with a charge of atmospheric air to further aid in the cooling and the leaning of the air-fuel mixture.

FIG. 8 depicts a modification wherein the fuel induction system A is centrally disposed with respect to a V-8 engine which functions in the same general manner as previously described.

In the discussion of the present invention, it is deemed to be well within the scope of the present disclosure to mount the fuel induction system at any feasible place on the vehicle and in this regard, the mounting bracket M of FIG. 1 merely typifies one manner in which the same can be accomplished. Also, and as seen in FIG. 5, clamp means N are shown for maintaining the ends of the hoses B in place and a modified heat exchange chamber 24, 25 is seen and both designs are considered to merely typify certain ways of accomplishing the same. Conceivably, other sources of heat could be used, for example, electrical heating means.

Additionally, it has not been considered necessary to explain the details of the various connection means, for example, the connection of tube 21 to chamber 24, as seen in FIG. 5 as any suitable connection means can be utilized.

In use, and when the engine is operating, a charge of gas and air is dispensed from the fuel metering device and air intake means into the interior of the mixing manifold A wherein, and due to the venturi, the lighter particles thereof make a 180° turn, as they egress from the conduit 16, and are discharged upwardly and outwardly through each of the hoses B associated with the discharge openings 14. These charges are more homogeneous and consequently, since the fuelinduction system is separated from the engine, are relatively cold when compared to a charge if the same were introduced into a conventional manifold of a vehicle. Thereafter, the charges are conducted into the cylinder inlets C and cooperate with the engine E pistons E to function in the normal manner. At a certain rpm, air can be automatically introduced into the cylinders under the control of a solenoid to further cool and lean the air-fuel charge. By the same token when the car is decelerated, the vacuum control valve 30 is opened to permit air to be introduced into the fuel induction system to further burn off or effect the vaporization of the particles. The vacuum control valve 30 and the solenoid controlled air introducing means are both optional to the overall operation of the vehicle and can be used as required.

In conclusion, it has been found that by introducing a cold charge of gas and fuel into the engine the pollutants normally associated with the hot charges of the conventional engine are greatly reduced.

What is claimed is:

1. In a vehicle having an engine including a plurality of air-fuel intake cylinders, and a source of air and fuel mixture therefor, the improvement including a manifold comprised of a readily removable, unitary housing having spaced end walls and an interconnecting wall joining said end walls, an inlet means adapted to be connected to said air-fuel source comprising a conduit disposed in one of said end walls and having a free end extending into the interior of the housing and terminating short of the other end wall, a plurality of substantially equally spaced discharge openings disposed in the interconnecting wall thereof remote from the said other end wall, said openings being disposed in a generally common plane, and a discharge opening provided in said other end wall opposite the free end of said conduit whereby lighter particles of said air and fuel mixture emanating from the conduit will be directed upwardly to be discharged through said openings with the heavier particles of said air and fuel mixture being directed downwardly to be discharged through said discharge opening, means adapted to connect each of said openings to a respective one of said cylinders and conducting said air and fuel mixture thereto, said conducting means being made from non-heat conducting material whereby the housing is separated from said engine a distance to minimize heat exchange relationship therewith, and recirculating means adapted to connect said discharge opening to said source of air and fuel for recirculating said heavier particles.

2. The combination of claim 1 wherein the housing is circular in configuration with the plurality of said equally spaced openings being disposed in a common radial plane.

3. The combination of claim 1 wherein a venturi means is placed in said conduit for accelerating the air and fuel mixture being dispensed therefrom into the interior of the housing whereby the lighter particles will be directed upwardly to be discharged substantially equally out of said openings.

4. The combination of claim 3 wherein a ramp means is disposed at the lower end of said housing to gather and receive said heavier particles and conduct the same outwardly into said recirculating means.

5. The combination of claim 4 further including heating means and said recirculating means being in heat exchange relationship therewith before returning said heavier particles to said housing.

6. The combination of claim 5 wherein a vacuum control valve means is disposed in the conduit and is operable at a desired vacuum to introduce additional air therein.

7. The combination of claim 6 wherein valve controlled air inlet means are disposed with selected ones of said cylinders to permit the addition of atmospheric air into said cylinders at a certain rpm to further cool and lean the air and fuel mixture entering therein.

8. The combination of claim 6 wherein the vacuum control valve means is an elongated housing having openings at each end thereof with one open end communicating with the conduit and with the other end being selectively opened and closed by a spring biased ball cooperating therewith.

9. The combination of claim 1 wherein the engine is a V-8 and the housing is disposed medially thereof.

10. The combination of claim 5 wherein the heating means comprises a chamber having two compartments with one receiving the heavy particles and the other receiving heat from the exhaust manifold of the engine.

11. The combination of claim 4 wherein the ramp means and the discharge opening are formed as a single funnel shaped unit.

12. The combination of claim 3 wherein the venturi means is pressed fit into the free end of said conduit.

13. The combination of claim 3 wherein the venturi means and discharge opening are formed as a single unit.

* * * * *